United States Patent [19]

Boyd

[11] 4,190,170

[45] Feb. 26, 1980

[54] SNUFF CAN AND THE LIKE

[75] Inventor: Eugene J. Boyd, Addison, Ill.

[73] Assignee: United States Tobacco Company, Greenwich, Conn.

[21] Appl. No.: 3,748

[22] Filed: Jan. 15, 1979

[51] Int. Cl.[2] ..... B65D 51/16

[52] U.S. Cl. ..... 215/307; 220/367

[58] Field of Search ..... 220/367, 306; 215/307, 215/317, 321, 365; 222/478

[56] References Cited

U.S. PATENT DOCUMENTS

| | | | |
|---|---|---|---|
| 3,010,596 | 11/1961 | Williams | 215/307 |
| 3,437,224 | 4/1969 | Williams | 215/307 |
| 3,811,592 | 5/1974 | Dye | 215/307 |
| 4,098,421 | 7/1978 | Foster | 215/321 |

FOREIGN PATENT DOCUMENTS

| | | | |
|---|---|---|---|
| 1486483 | 6/1967 | France | 215/307 |
| 595392 | 8/1957 | Italy | 215/307 |
| 741872 | 12/1955 | United Kingdom | 215/307 |

*Primary Examiner*—Ro E. Hart

*Attorney, Agent, or Firm*—Harold L. Stults

[57] ABSTRACT

A flat can of a size which will fit in a person's pocket which is suited particularly for snuff, but is adapted for use with other products. The can has a bottom wall and a cylindrical side wall, and there is a lid with a top wall and a downwardly-extending peripheral flange which fits snugly around the neck of the cylindrical side wall. The lid is held in place by circumferential rib structures, respectively on the outer surface of the neck of the side wall and on the inner surface of the lid flange. There are also vertical ribs on the can neck which extend upwardly from the peripheral rib and which provide venting when the lid is installed. The vertical ribs are in pairs spaced a short distance from each other and there is a gap in the peripheral rib on the neck between the bottom ends of each pair of vertical ribs. When the lid is being installed or removed, the circumferential rib on the lid flange rides upon the vertical ribs so as to facilitate the movement of the lid flange on the neck. The rib structure on the lid flange is also formed by spaced segments with gaps between their ends. The arrangement is such that a plurality of vertical vent passageways between the respective pairs of vertical ribs are in alignment with gaps in the circumferential rib construction on the lid flange. Hence, when the lid is in place, the can is still vented, and the product in the can is properly vented when that is desirable. However, when the product in the can must be sealed, a circumferential label or wrapper of impervious material is placed on the can after the lid has been put into place.

6 Claims, 6 Drawing Figures

SNUFF CAN AND THE LIKE This invention relates to containers and particularly to cans for snuff, and also to containers which are adaptable for use in packaging other granular products.

An object of this invention is to provide improved containers for granular products. A further object is to provide improved plastic cans for use in packaging and distributing snuff, and thereafter for use by the consumer. Another object is to provide cans which can be closed and opened easily without sifting or spilling the product and which also provide for venting with the can fully closed, when that is desirable. A further object is to provide a can for snuff which is properly vented when the lid is being installed and removed.

The term "can" is used herein in the broad sense of being synonymous with "box" or "container". A plastic snuff can is disclosed in U.S. Pat. No. 4,098,421 which has the same general characteristics and certain of the specific characteristics of the illustrative embodiment of the present invention. The illustrative cans disclosed in that patent and the present application are of plastic, and are flat and cylindrical. Also, they have lids with peripheral flanges, and the lids are held in place by circumferential mating ribs on the can necks and the lid flanges. In addition, there are vertical ribs on the necks of the cans which hold the lid flanges away from the can surfaces as the lids are being installed and removed. Those vertical ribs vent the cans as the lid is moving toward and away from its installed position, but the can disclosed in that patent is sealed when the circumferential ribs are moving to the mating relationship and then with the lid fully closed. It is an object of the present invention to provide a plastic snuff can which provides proper venting when the lid is fully seated where that is desirable.

Cans constructed in accordance with the present invention provide complete venting during the entire movement of the lid to and from the can body, and also after the lid is in its fully installed position when that is desirable. However, a circumferential label or wrapper can be placed around the periphery of the can covering the area adjacent the bottom of the lid flange. If it is desirable for the product in the can to be completely sealed, that label or wrapper is impervious to vapor and gas, so that the can is then completely sealed. However, venting is provided when the label or wrapper is pervious to vapor and gases.

IN THE DRAWINGS

Figure 1:
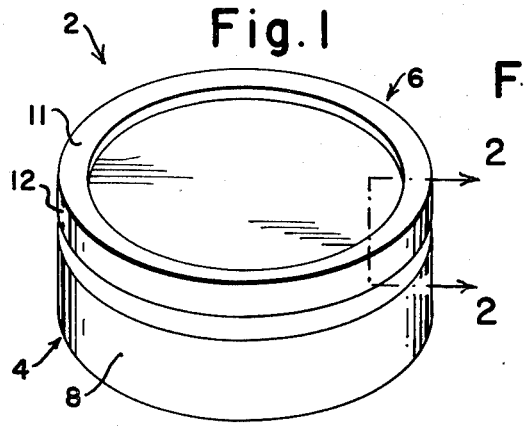
FIG. 1 is a perspective view of one embodiment of the invention.

Referring to FIG. 1 of the drawings, a can 2 is formed by an open top can body 4 and a lid 6. Can body 4 has a bottom wall 5 (see FIG. 4) and a cylindrical side wall 8. The top of the side wall has a neck 7 of reduced diameter, and a frusto-conical surface 9 extending between the outer surfaces of the neck and the bottom portion of wall 8. Lid 6 (see FIG. 3) has a top wall 10 and a cylindrical flange 12. The main portion of the top wall is recessed below the edge portion 11. Lid 6 (see FIG. 2) fits snugly onto neck 7, and the bottom edge 27 of flange 12 is tapered to form a frusto-conical surface 29. The outer cylindrical surface of the lid is the same as that of the portion of side wall 8 below neck 7. Hence, the can is compact and flat and is ideally suited to package snuff and for the customer to carry in a pocket or otherwise. The bottom edge 27 of the lid is so spaced with respect to surface 29 of the can that the lid flange can be grasped along the surface 29 and flexed outwardly so as to remove the lid with a smooth progressive action. That feature is important for products such as snuff where the can is used by the customer who opens and closes the can frequently.

Figure 4:
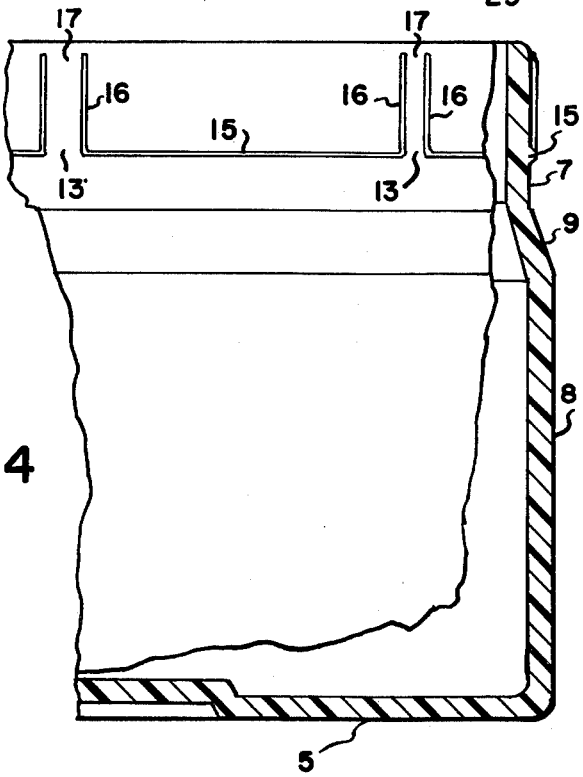
FIG. 4 is an enlarged fragmentary side elevation of the can with the right-hand wall and the bottom wall portion in vertical section.
Figure 5:
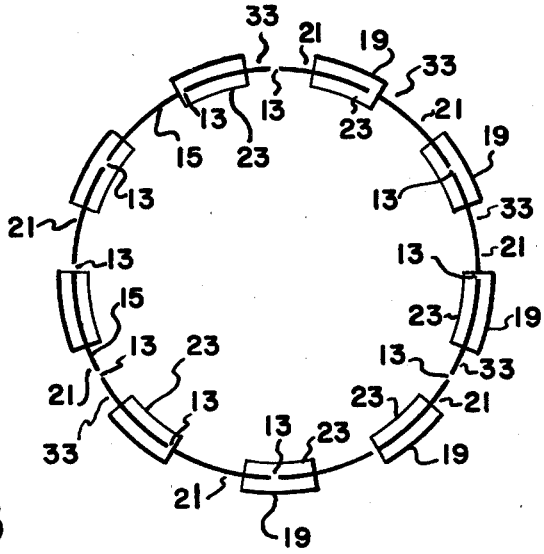
FIG. 5 is a schematic representation showing the relationship between the components of the can and lid which provide venting of the can; and, FIG. 6 is a reduced bottom fragmentary view of the portion of the lid at the right-hand side of FIG. 3.

Projecting from the outer surface of neck 7 (see FIG. 4) is a circumferential rib structure formed by twelve aligned arcuate rib segments 15, and twenty-four vertical ribs 16. Each rib segment 15 is separated from the next adjacent rib segment by a vent gap 13. Ribs 16 are positioned respectively at the ends of the rib segments 15 and extend to the top of neck 7. Hence, ribs 16 are in pairs spaced from each other the width of the gaps 13, and when lid 6 is in place, each pair of ribs 16 forms a vent passageway or slot 17 between the surfaces of neck 7 and lid flange 12 from the top of the can downwardly past rib segments 15. Projecting radially inwardly from the inside cylindrical surface of flange 12 (see FIG. 3) is a circumferential rib structure which is formed by nine aligned arcuate rib segments 19, each of which extends (see FIG. 5) through an arc of 20° around the vertical axis of the can and is separated from each of the next adjacent rib segments by a vent gap 21 which also extends through an arc of 20° around the flange.

Figure 2:
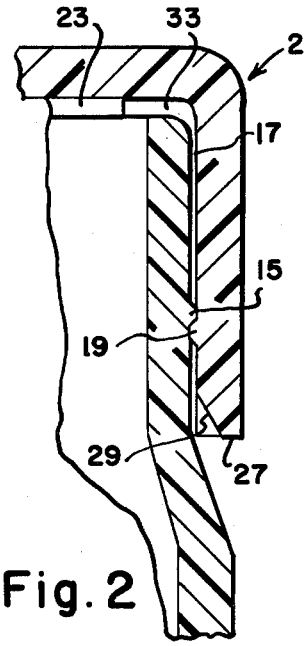
FIG. 2 is a greatly-enlarged vertical sectional view on the line 2—2 of FIG. 1.
Figure 3:
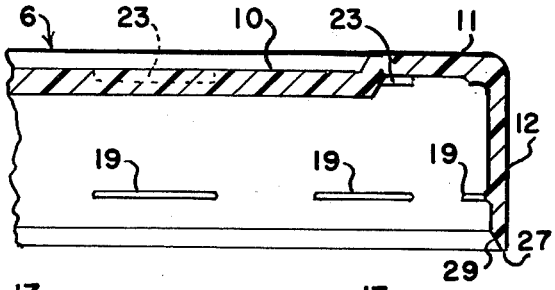
FIG. 3 is an enlarged vertical sectional view of the lid only, and on the same line as FIG. 2.
Figure 6:
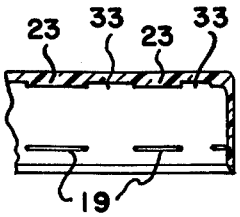

As shown in FIG. 6 and in the upper right-hand portions of FIGS. 2 and 3, top wall 10 of the lid has nine arcuate lands 23 which extend from flange 12 the width of portion 11. Each of the lands extends arcuately 20° around the vertical axis of the lid and they are equally spaced 20° arcuately from each other. When lid 6 is in place on can 4, lip 31 of the can rests against lands 23 (see FIG. 2) so that the can lip is held away from the bottom surface of the lid through the arcuate area between the lands. That produces nine vent passageways 33 around the top of the lip between the inside of the can and passageways 17. Lands 23 are in vertical alignment with the respective ribs 19 so that with the lid in a given position on the can, and with a certain passageway 17 in alignment with one of the gaps 21 between ribs 19, that passageway 17 is also in alignment with a gap 33 between lands 23. That relationship is represented schematically in FIG. 5, and it should be understood that the vent gaps 13 and the vent passageways 17 are always in alignment and are identified by the numeral 13 in FIG. 5. With the relationship shown, each of a plurality of vent passageways 17 and its vent gap 13 is in alignment with vent passageway 23 and also with vent gap 21. The vent gaps and passageways will now be referred to relative to the numerals of a clock, e.g., the vent gap 13 at the top of FIG. 1 is at twelve o'clock and is in alignment with a vent passageway 33 and a vent gap 21, and the same is true at four o'clock and eight o'clock. Therefore, those vent gaps 13 and their vent passageways 17 are fully open to venting the can.

Vent gaps 13 at two, six and ten o'clock are positioned between vent gaps 21 so that they are fully blocked, but the other six vent gaps 13 and their vent passageways 17 are half-open so that they provide additional venting. If the lid is rotated clockwise from the position shown through an arc of the order of 1.4° to 8.6°, six of the vent gaps 13 are in alignment with vent gaps 21 and vent passageways 17. If that rotation is continued, and the total movement from the position shown is from 8.6° and 11.4°, or from 18.6° and 20°, the total cross-section of vent gaps 13 which are open remain substantially the same. When the arc of clockwise movement from the position shown is between 11.4° and 18.6°, six of vent gaps 13 are fully open. For continued turning of the lid with respect to the can, there is a repeat pattern of closing various of the vent gaps and opening others, but there is no position where the venting is unsatisfactory.

In the illustrative embodiment of the invention, the outside diameter of can 4 is 2.575 inches, and the thickness of the walls of the can and lid are 0.03 inch. The rib segments and ribs 16 are 0.002 inch high and 0.018 inch wide. Ribs 16 extend from 0.012 inch below the top edge of wall 8 to rib segments 15, the bottoms of which are 0.15 inch from the top of the wall. Rib segments 15 and 19 and ribs 16 are flat-topped with tapered side surfaces. The top edges of ribs segments 19 are 0.15 inch from the bottom surface of wall 10 of the lid so that their top surfaces mate with the bottom surfaces of rib segments 15 when the lid is in position on the can. As indicated above, rib segments 19 ride upon ribs 16 as the lid is moved onto and off the can. Hence, the lid rides freely into place on the can and rib segments 19 snap in below rib segments 15. Lands 23 are 0.002 inch high.

As indicated above, the annular recess at the bottom of flange 12 permits the user to engage the bottom of the lid and flex it outwardly when removing it. It will be seen that the lid is easily removed and replaced without a jerking action which would result in spilling the product, and with proper venting to permit the passage of air from and to the can. The vent paths formed by passageways 33 and 17 are thin and relatively long so that any product particles which are sifted over the top of the can will tent to remain in the vent passageways. That insures against objectionable sifting of product particles from the can. Other venting arrangements involving the provision of vent holes in the lid can result in minute particles of the product escaping and soiling the outside of the can or clothing. The provision of means to provide thin and relatively long vent passageways from the top of the can vertically to the bottom of the lid flange is an important aspect of this invention. That involves providing one or more vertical passageways between the mating surfaces of the lid flange and the can neck, and that must be done witout interfering with the smooth movement of the lid to and from the can. Each pair of parallel ribs 16 in effect provides a vertical groove while supporting the lid flange during its sliding movement.

It is understood that changes can be made in the illustrative embodiment, and that other embodiments of the invention can be provided, all within the scope of the claims.

What is claimed is:

1. A can construction comprising, the combination of, a can formed by a bottom wall and an upwardly extending cylindrical side wall, and a lid comprising a top wall and a downwardly extending peripheral flange having an inside diameter and configuration such as to be snugly received upon the top of said cylindrical side wall, said flange having a circumferential rib structure upon its inner surface projecting radially inwardly from adjacent its bottom edge, said side wall having a circumferential rib structure projecting radially outwardly from said side wall and positioned so that its bottom edge mates with the top edge of the first-named rib structure so as to hold said lid onto the top of said can, said can and said lid being of plastic and being sufficiently deformable so that said flange can be flexed outwardly to remove the lid from the can and to flex when the lid is being installed onto the can, said can having a plurality of vertical vent passageways from the top of said can and past the said rib structure on said side wall, said rib structure on said flange having a plurality of vent gaps which are so positioned that one or more of said vent passageways is in alignment with one or more of said vent gaps.

2. A can as described in claim 1, wherein the bottom edge of said flange is tapered to form an edge at the outer cylindrical surface of said flange, said cylindrical side wall having a neck portion which is of reduced diameter and is substantially coextensive with said flange when said lid is positioned on said can, and wherein the remainder of said side wall has substantially the same outside diameter as said flange, said side wall having a frusto-conical surface at the bottom edge of said neck which is spaced from the bottom edge of said flange to form a slot which can be grasped to draw the bottom of said flange outwardly away from said side wall when removing said lid from said can.

3. A can as described in either claim 1 or claim 2, wherein said circumferential rib structure on said flange comprises nine rib segments each of which extends through an arc of the order of 20° with respect to the axis of said flange and which are in alignment around said flange and are separated from each other by the bottom ends of said vent passageways, said rib structure on said side wall comprising twelve aligned arcuate segments which are separated from each other by gaps and are equally spaced around the periphery of said side wall.

4. A can as described in either claim 1 or claim 2, wherein each of said vent passageways is formed by a pair of parallel ribs extending from adjacent the top of said side wall down to said rib structure on said side wall and a gap in said rib structure on said side wall with said parallel ribs forming the side edges of the said vent passageway and the coextensive surfaces of said side wall and said flange forming side faces of the vent passageway.

5. A can which is suited for packing granular products comprising, the combination of, an open top can having a bottom wall and an upwardly-extending cylindrical side wall, and a lid positioned upon the open top of said can and having a top wall and a downwardly-extending peripheral cylindrical flange which fits snugly around the top of said side wall, the top portion of said side wall having a circumferential rib structure which is positioned a predetermined distance below the top edge of said side wall which distance is less than the width dimension of said flange, said rib structure comprising a plurality of arcuate rib segments which are positioned end-to-end around said side wall with each end of each segment being separated from the adjacent end of another segment by a vent gap, said flange having a circumferential rib structure upon its inner cylindrical surface which is formed by a plurality of arcuate rib segments which are positioned in spaced aligned relationship from each other around said surface to thereby form vent gaps, means forming a plurality of vent channels extending from the top of said cylindrical side wall to each of said vent gaps of the first-mentioned of said rib structures, the second-named of said circumferential rib structures being positioned below and in cooperating relationship with the first-named of said rib structures whereby said rib structures retain said lid on said can, said gaps in said rib structures providing vent passageways from said vent channels and thence from the top of said can.

6. A can as described in claim 5, wherein said vent channels are formed by ribs upon said side wall and gaps in said circumferential rib structures.

* * * * *